US006532870B1

(12) United States Patent
Kato et al.

(10) Patent No.: US 6,532,870 B1
(45) Date of Patent: Mar. 18, 2003

(54) PROCESS FOR PREPARING INK-JET SYSTEM PRINTING PLATE

(75) Inventors: Eiichi Kato, Shizuoka (JP); Sadao Osawa, Shizuoka (JP); Hiroyuki Ohishi, Shizuoka (JP); Kazuo Ishii, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 08/906,815

(22) Filed: Aug. 6, 1997

(30) Foreign Application Priority Data

Aug. 16, 1996 (JP) ..... 8-234731

(51) Int. Cl.[7] ..... B41C 1/10
(52) U.S. Cl. ..... 101/465; 101/466; 347/103
(58) Field of Search ..... 101/463.1, 465, 101/466, 467; 430/49, 87, 96, 126; 347/88, 99, 103

(56) References Cited

U.S. PATENT DOCUMENTS 4,833,486 A * 5/1989 Zerillo ..... 101/466
5,053,301 A * 10/1991 Kato et al. ..... 430/49
5,072,671 A * 12/1991 Schneider et al. ..... 101/467
5,219,705 A * 6/1993 Kato et al. ..... 430/302
5,582,106 A * 12/1996 Kanda et al. ..... 101/462
5,677,098 A * 10/1997 Nakayama et al. ..... 430/95
5,714,250 A * 2/1998 Kato et al. ..... 101/458

* cited by examiner

*Primary Examiner*—Stephen R. Funk
(74) *Attorney, Agent, or Firm*—Reed Smith LLP

(57) ABSTRACT

A process for preparing an ink-jet system printing plate, wherein an image is formed according to a hot melt type ink-jet system by heat-melting an ink composition that is solid at ordinary temperature, spraying droplets of the ink composition in a hot melt state from nozzles onto an intermediate transferrer to form an image, and contact-transferring the image on the intermediate transferrer to an image receiving layer of a planographic printing plate precursor, the image receiving layer being provided on a water-resistive support and containing zinc oxide and a binder resin, and thereafter, a nonimage area of the image receiving layer is desensitized by chemical reaction treatment to prepare a planographic printing plate.

7 Claims, 3 Drawing Sheets

PROCESS FOR PREPARING INK-JET SYSTEM PRINTING PLATE

FIELD OF THE INVENTION

The present invention relates to a process for preparing a planographic printing plate for an ink-jet recording system, and especially, to a process for preparing a printing plate for a hot melt type ink-jet system which is satisfactory in image qualities of both the printing plate and printed matter.

BACKGROUND OF THE INVENTION

On account of the recent progress in office appliances and office automation, an offset planographic printing system spreads throughout the small printing field, in which a printing plate is prepared, that is, image formation is performed by various processes on a fresh direct drawing type planographic printing plate precursor that has on a water-resistant support an image receiving layer having a water-receptive surface.

In conventional direct drawing type planographic printing plate materials, image accepting layers (or image receiving layers) containing inorganic pigments, water-soluble resins, and water resistance enhancers are provided on supports such as paper having undergone a water resistance treatment and plastic films. In known processes for making printing plates, lipophilic images are formed on such fresh direct drawing type planographic printing plate precursor by the use of lipophilic inks, with typewriters, by handwriting, by hot melt transfer of images from ink ribbons with heat transfer printers, or by the use of ink-jet printers using liquid inks.

The printing plates thus made, however, fail to have sufficient mechanical strength in the image areas which causes falling off of the image areas during printing.

In platemaking by the use of the ink-jet printers in which liquid inks are used, in order to prevent image forming agents in the liquid inks from diffusing or being absorbed in the plate materials and mitigate blurs of images, JP-A-64-27953 (The term "JP-A" as used herein means an "unexamined published Japanese patent application") discloses a hot melt type ink-jet process (occasionally referred to as a "solid-jet process") in which a hydrophobic solid ink that changes to a liquid by hot melting is used. The image receiving layer of a printing plate precursor used herein has a water receptive surface.

Even in this process, however, blurs are actually observed in image areas of printed matter obtained from the printing plate thus made, and in addition, the number of sheets which can be printed is inadequately only a few hundred at most.

SUMMARY OF THE INVENTION

An object of the present invention is to provide a process for preparing a printing plate of a hot melt type ink-jet system from which a number of printed sheets having sharp images can be obtained.

The object given above has been achieved by embodiments of the present invention as described in the following items (1) to (4):

(1) A process for preparing an ink-jet system printing plate, wherein an image is formed according to a hot melt type ink-jet system by heat-melting an ink composition that is solid at ordinary temperature, spraying droplets of the ink composition in a hot melt state from nozzles onto an intermediate transferrer to form an image, and contact-transferring the image on the intermediate transferrer to an image receiving layer of a planographic printing plate precursor, the image receiving layer being provided on a water-resistive support and containing zinc oxide and a binder resin, and thereafter, a nonimage area of said image receiving layer is desensitized by chemical reaction treatment to prepare a planographic printing plate.

(2) A process for preparing the ink-jet system printing plate as described in item (1), wherein the surface of the image receiving layer of the planographic printing plate precursor has a Bekk smoothness degree of at least 30 seconds per 10 ml and a water-contact angle of 50° or more.

(3) A process for preparing the ink-jet system printing plate as described in item (1), wherein the ink composition contains a wax having a melting point of from 50° to 150° C., a resin, a color material, and an adhesion modifier and turns to a hot melted liquid by heating to 80° C. or higher, the hot melted liquid having a viscosity of from 1 to 20 cps.

(4) A process for preparing the ink-jet system printing plate as described in item (1), wherein the support surface adjacent to the image receiving layer has a Bekk smoothness degree of at least 300 seconds per 10 ml.

In the present invention, a hydrophobic ink image is formed on the hydrophobic image receiving layer containing zinc oxide according to the hot melt type ink-jet system, and a nonimage area is then made water-receptive. Therefore, the system of the present invention provides much more improved images to both the printing plate precursor and printed matter, and in addition, an excellent press life to the printing plate, as compared with a hot melt type ink-jet system in which a hydrophobic ink image is formed on a water-receptive image receiving layer. Further, use of the intermediate transferrer enables pressure and temperature of ink to be appropriately controlled when transferred to a printing plate precursor, and holding power of an image to the printing plate precursor can also be extremely increased, which also makes it possible to improve the press life of the printing plate precursor.

DETAILED DESCRIPTION OF THE INVENTION

Figure 1:
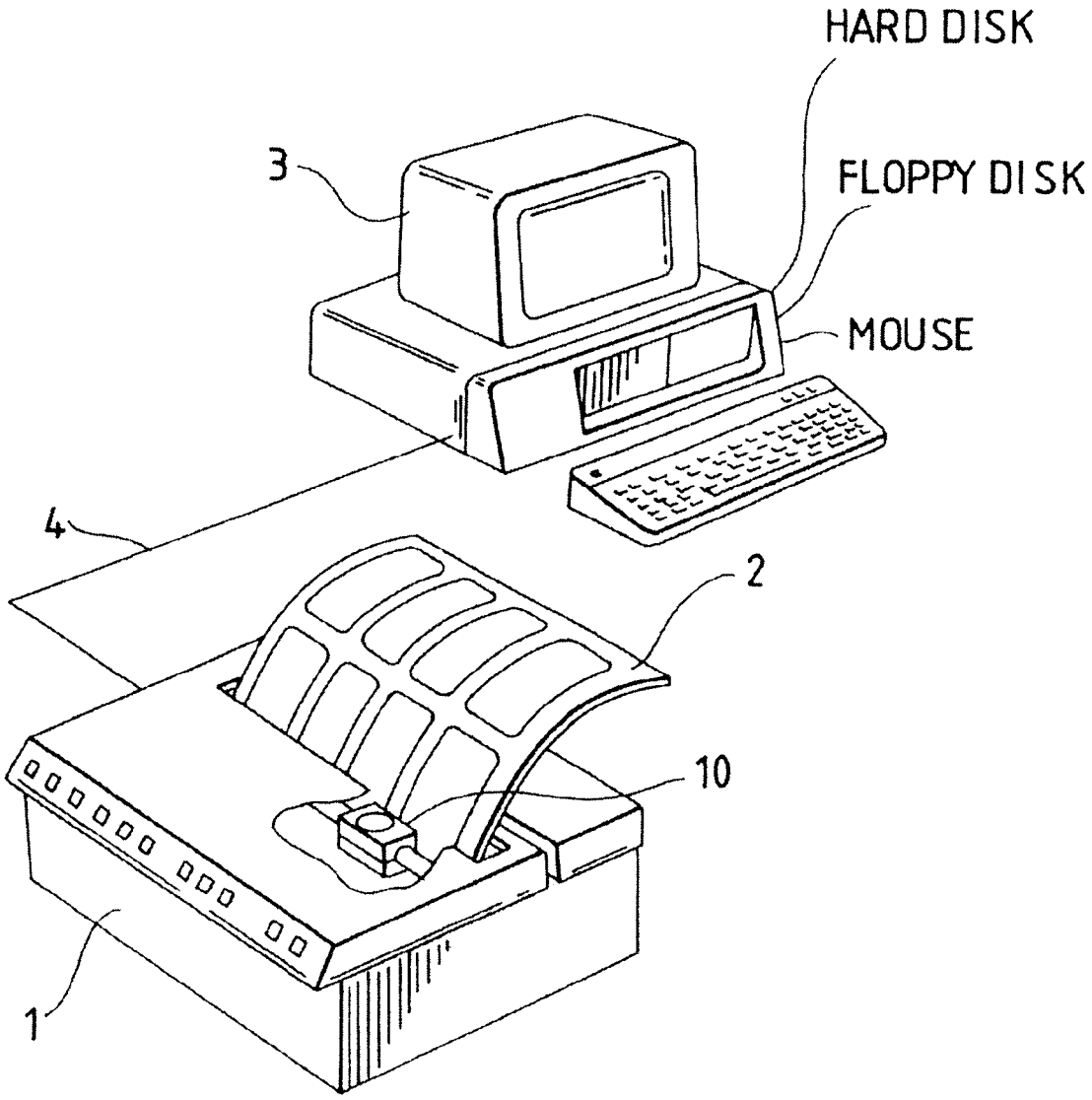
FIG. 1 is a schematic view showing an example of a device system used in the present invention as an example.

The present invention is described in detail below. A feature of the present invention is that an image is formed on an image receiving layer having a hydrophobic surface via an intermediate transferrer according to a hot melt type ink-jet system or a solid-jet system by the use of an ink composition, that is, an image forming component which is hydrophobic and solid at ordinary temperature (35° C. or lower), and an image layer thus formed retains adequate affinity for the image receiving layer bonding or adhering thereto, thus producing a stable image area in which the image layer has resistance to failing or separation.

In this case, the image receiving layer contains zinc oxide and a binder resin, and the hydrophobic degree of the surface thereof is 50° or more in water-contact angle; and in view of ink receptivity, preferably from 50° to 130°, more preferably from 50° to 120°, and particularly preferably from 55° to 110°.

When the water-contact angle is within the scope given above, the strength of the image layer as described above is sufficiently retained, and a sharp image is formed without disorders of images in fine lines, small characters, and halftone dots. Values of the contact angle are those measured with a contact angle meter by a droplet method using distilled water.

On the other hand, JP-A-64-27953 discloses a solid-jet system similar to the present invention, in which the image receiving layer of a printing plate precursor has a water-receptive surface that is 20° or less in the water-contact angle, the surface differing from that of the hydrophobic image receiving layer of the present invention. Such a printing plate precursor is markedly inferior to that of the present invention in image reproducibility and a press life.

In the present invention, the smoothness of the image receiving layer's surface is preferably at least 30 seconds per 10 ml, and more preferably from 45 to 300 seconds per 10 ml in Bekk smoothness degree.

The smoothness of the image receiving layer's surface which falls in the ranges given above results in forming a sharp image without any defects in image, and in addition, in improving adhesion of the image area to the image receiving layer due to an increase in adhesion area to provide a remarkably improved press life more than 1000 sheets.

The Bekk smoothness degree can be measured with a Bekk smoothness degree testing machine. The testing machine has a circular plate of glass which is finished to a highly smooth surface and has a hole in the center. A specimen is pressed against the plate of glass under a constant pressure (1 kg/cm$^2$) and time required for a constant amount of air (10 ml) to pass between the glass plate surface and the specimen under a reduced pressure is measured.

The adhesion of the image area to the image receiving layer and the press life are particularly improved by keeping the smoothness of the image receiving layer's surface in the ranges given above and by using, as the ink composition being solid at ordinary temperature, an ink composition which contains a wax having a melting point of 50° to 150° C., a resin, and an adhesion modifier and turns to a hot melted liquid having a viscosity of 1 to 20 cps by heating to 80° C. or higher. The probable cause of such improvements consists in an increase in affinity between the image receiving layer's surface and the ink composition having turned to a hot melted liquid, and in addition, in improvement in image reproducibility without blur of ink.

In the present invention, the image reproducibility and the press life can be further improved by restricting the smoothness of the support surface adjacent to the image receiving layer to at least 300 seconds per 10 ml in Bekk smoothness degree. Even when the image receiving layer's surface has similar smoothness, such improvements can be attained, because increase in smoothness of the support surface probably improves the adhesion between the image area and the image receiving layer.

A process for preparing a printing plate of the present invention is explained below.

The first explanation refers to a planographic printing plate precursor having an image receiving layer which is provided on a water-resistant support used in the present invention and contains at least zinc oxide and a binder resin.

Zinc oxide used in the present invention include all those which are being marketed as zinc oxide, zinc white, wet zinc white, and activated zinc white as described, for example, in *Shinpan Ganryo Binran* (*New Edition Handbook of Pigments*), edited by Nippon Ganryo Gijutsu Kyokai, Seibundo, page 319 (1968).

That is, the zinc oxide include those which are called dry processes such as the French process (indirect process) and the American process (direct process) and wet processes according to starting materials and manufacturing processes. They are being marketed, for example, by Seido Chemical Co., Ltd., Sakai Chemical Co., Ltd., Hakusui Chemical Co., Ltd., Honso Chemical Co., Ltd., Toho Zinc Co., Ltd., and Mitsui Mining and Smelting Co., Ltd.

The content of the zinc oxide in the image receiving layer is preferably from 90% to 75% by weight, and more preferably from 88% to 78% by weight.

The zinc oxide content which falls in these ranges promotes the effect of the present invention. The content not reaching these ranges leads to insufficient water wettability of the image receiving layer's surface in desensitizing treatment, which fails to practically acquire the effect of the present invention. On the other hand, too much zinc oxide makes it difficult to ensure a necessary amount of a binder resin.

The binder resins used for the image receiving layer of the present invention are hydrophobic resins which can form the image receiving layer together with zinc oxide as described above and adjust the contact angle of the image receiving layer's surface so as to fall in the ranges given above. The weight average molecular weight of the resins is preferably from $10^3$ to $10^6$, and more preferably from $5\times10^3$ to $5\times10^5$. The glass transition point of the resins is preferably from 0 to 120° C., and more preferably from 10° to 90° C.

Examples of such the resins include vinyl chloride-vinyl acetate copolymers, styrene-butadiene copolymers, styrene-methacrylate copolymers, methacrylate copolymers, acrylate copolymers, vinyl acetate copolymers, polyvinyl butyral, alkyd resins, epoxy resins, epoxyester resins, polyester resins, and polyurethane resins.

These resins can be used singly or as a mixture of two or more kinds thereof.

The ratio of the resins and zinc oxide in the image receiving layer is preferably from 9/91 to 25/75 and more preferably from 10/90 to 22/78, in resin/zinc oxide weight ratio.

Other constituent components than the components as described above can also be incorporated into the image receiving layer of the present invention.

One of such the constituent components is inorganic pigments other than zinc oxide used in the present invention. Examples of such the inorganic pigments include kaolin clay, calcium carbonate, barium carbonate, calcium sulfate, barium sulfate, magnesium carbonate, titanium oxide, silica, and alumina. When these inorganic pigments are used together with zinc oxide, the amount thereof can not exceed 20 parts by weight, based on the zinc oxide of the present invention.

To promote desensitizing of the image receiving layer, resin particles such as acrylic acid resin particles containing particular functional groups can be further added to the layer, and examples of such resin particles are described, for example, in JP-A-4-201387, JP-A-4-223196, JP-A-4-319491, JP-A-5-58071, JP-A-4-353495, JP-A-5-119545. It is usually preferred that these resin particles are spherical and the average particle size thereof is preferably from 0.1 to 2 $\mu$m.

Use of said other inorganic pigments than zinc oxide or resin particles in the respective ranges given above leads to sufficient desensitizing (water wettability) of a nonimage area by desensitizing treatment to inhibit scumming in printed matter, and allows an image area to strongly adhere to the image receiving layer to prevent image defects from generating in spite of a great number of printed sheets. Thus, the printing plate can acquire an adequate press life.

The amount of the binder resins in the image receiving layer is generally from 10 to 25 parts by weight, preferably from 13 to 22 parts by weight per 100 parts by weight of the pigments (including zinc oxide). These ranges make it possible to efficiently develop the effect of the present invention, and in addition, to keep film strength during printing and maintain high water wettability obtained by desensitizing treatment.

Besides, crosslinking agents can also be incorporated into the image receiving layer to much more improve film strength.

The crosslinking agents used in the present invention include compounds which are usually used as crosslinking agents, and examples thereof are those described in *Kakyozai Handbook* (*Handbook of Crosslinking Agents*), edited by Shinzo Yamashita and Tosuke Kaneko, Taiseisha, 1981; and *Kobunshi Data Handbook; Kisohen* (*Data Handbook of Polymers; Basic Edition*), edited by Kobunshi Gakkai, Baifukan, 1986.

In the present invention, reaction accelerators can also be added, as needed, to the image receiving layer to promote the crosslinking reaction.

When the crosslinking reaction is of a type in which chemical bonds between functional groups are formed, examples of the crosslinking agents include organic acids (e.g., acetic acid, propionic acid, butyric acid, benzenesulfonic acid, p-toluenesulfonic acid, etc.), phenols (e.g., phenol, chlorophenol, nitrophenol, cyanophenol, bromophenol, naphthol, dichloro-phenols, etc.), organic metal compounds (e.g., acetylacetonato-zirconium, zirconium acetylacetonate, cobalt acetylacetonate, dibutoxytin dilaurate, etc.), dithiocarbamic acid compounds (e.g., diethyl dithiocarbamate, etc.), thiuram disulfide compounds (e.g., tetramethyl thiuram disulfide, etc.), carboxylic acid anhydrides (e.g., phthalic anhydride, maleic anhydride, succinic anhydride, butylsuccinic anhydride, benzophenone-3, 3',4,4'-tetracarboxylic acid dianhydride, trimellitic acid anhydride, etc.). When the crosslinking reaction is of a polymerization reaction type, the crosslinking agents are polymerization initiators (e.g., peroxides, azobis series compounds, etc.).

After the image receiving layer compositions are applied to supports, the binder resins are preferably hardened with light and/or heat. Thermal hardening can be carried out, for example, by drying the image receiving layers under more severe conditions than those for providing conventional image receiving layers. It is preferred that drying is done at a higher temperature and/or for a longer time than usual, or after drying up the coating solvent, heating is further continued. For example, the drying is performed at 60° to 150° C. for 5 to 120 minutes. Simultaneous use of the reaction accelerators described above enables the drying to be carried out under milder conditions.

Photo-setting of particular functional groups in the binder resins may be also carried out. For setting by irradiation with light, a step of irradiation with chemically active rays may be inserted into the process for preparing a printing plate. All of visible rays, ultraviolet rays, far ultraviolet rays, electron rays, X rays, gamma rays, and alpha rays can be employed as the chemically active rays. Of these, the ultraviolet rays are preferred, and rays having wavelengths in the region of 310 to 500 nm are more preferred. Low pressure, high pressure, and super high pressure mercury vapor lamps and halogen lamps are commonly employed. Irradiation with light can be sufficiently carried out at a distance of 5 to 50 cm for 10 seconds to 10 minutes.

In the present invention, the thickness of the image receiving layer is preferably from about 3 to about 30 grams per $m^2$ of the printing plate precursor in terms of the coating amount (after drying) of the image receiving layer composition. The image receiving layer usually has a void of from about 3% to about 50% by volume, and preferably from about 10% to about 40% by volume.

The image receiving layer of the present invention is provided on a water-resistant support. Examples of the water-resistant support include paper which has undergone water resistance treatment, plastic films, paper and plastic films laminated to metal foil, and the like.

In the present invention, the smoothness of the support surface adjacent to the image receiving layer is preferably adjusted to at least 300 seconds per 10 ml, more preferably from 900 to 3000 seconds per 10 ml, and most preferably to from 1000 to 3000 seconds per 10 ml in Bekk smoothness degree.

A highly smooth surface thus restricted of the water-resistant support herein means a surface on which the image receiving layer is directly formed. For example, when an underlayer or an overcoat layer as described later is formed on a support, the highly smooth surface means a surface of the underlayer or the overcoat layer.

Thus, the surface condition of the image receiving layer adjusted as described above is completely maintained without undergoing an influence of unevenness of a support surface to increasingly contribute to improvement in image quality.

A variety of known methods can be employed to adjust the support surface within the ranges of smoothness as specified above. For example, melt adhesion of a resin to a substrate surface, calender reinforcement by the use of highly smooth heated rollers, or the like can be performed to adjust the Bekk smoothness degree of the support surface.

In the present invention, the melt adhesion of the resin to the substrate surface is preferably carried out according to an extrusion-lamination process. A support adjusted to desired smoothness can be prepared by covering the substrate according to the extrusion-lamination process. In the extrusion-lamination process, base paper is subjected to pressing to a film immediately after the film is formed from the resin melted, and then cooled to be laminated. Various devices are known for the process.

In view of stability to manufacturing, the thickness of a laminated resin layer is 10 $\mu$m or more, and preferably from 10 to 30 $\mu$m.

Examples of the resin employed for this purpose include polyethylene resins, polypropylene resins, acrylic resins, methacrylic resins, epoxy resins, and copolymers thereof. Two or more of these resins may also be employed at the same time. Of these, the polyethylene resins are preferred, and of the polyethylene resins, mixtures of low-density polyethylenes and high-density polyethylenes are particularly preferred. The mixtures provide uniformity of covering films and excellent resistance to heat. When electrically conductive substances are incorporated into the resin layers as described later, use of the mixtures provides excellent electrical conductivity.

The low-density polyethylenes preferably have a density of 0.915 to 0.930 gram/ml and a melt index of 1.0 to 30 grams per 10 minutes, and the high-density polyethylenes preferably have a density of 0.940 to 0.970 gram/ml and a melt index of 1.0 to 30 grams per 10 minutes. The preferred blend ratio is from 10% to 90% by weight of the low-density polyethylene to from 90% to 10% by weight of the high-density polyethylene.

When base paper is employed as a substrate, in order to improve the adhesion between the base paper and the resin layer, it is preferred to coat the base paper previously with polyethylene derivatives such as ethylene-vinyl acetate copolymers, ethylene-acrylic acid ester copolymers, ethylene-methacrylic acid ester copolymers, ethylene-acrylic acid copolymers, ethylene-methacrylic acid copolymers, ethylene-acrylonitrile-acrylic acid copolymers, and ethylene-acrylonitrile-methacrylic acid copolymers, or to expose the surface of the base paper to corona discharge previously. As other methods, the base paper can also be subjected to surface treatments as described in JP-A-49-24126, JP-A-52-36176, JP-A-52-121683, JP-A-53-2612, JP-A-54-111331, and JP-B-51-25337 (The term "JP-B" as used herein means an "examined Japanese patent publication").

The calender reinforcement listed as another method can be achieved by calender treatment of a substrate such as paper described later or of a support in which an underlayer is formed on the substrate. Conditions of the calender treatment can be appropriately controlled depending on substrates and compositions of the underlayer, and conditions such as the kinds and combinations of rolls such as metal rolls, resin rolls, and cotton rolls, the stage number of the calender rolls, the roll nip pressure, and the surface temperature of rolls can be appropriately selected.

In the present invention, an undercoat layer can be provided on a substrate to improve water resistance between the support and the image receiving layer and adhesion between the layers, and a backcoat layer (backside layer) can be formed on the support surface opposite to the image receiving layer for the purpose of curl suppression. The smoothness of the backcoat layer preferably falls in the range of 150 to 700 seconds per 10 ml in Bekk smoothness degree.

When the printing plate is supplied to an offset press, the smoothness thus specified enables the printing plate to be precisely placed on the offset press without generating a gap or sliding.

To adjust the smoothness of the underlayer and the backcoat layer of the support, respectively, it is desirable that the calender treatment is repeated a plurality of times, for example, the calender treatment is carried out after formation of the underlayer and the calender treatment is carried out again after formation of the backcoat layer, or that the adjustment of compositions (for example, ratios and particle sizes of pigments as described later) for the underlayer and the backcoat layer is suitably combined with the adjustment of conditions of the calender treatment to control the smoothness of these layers.

Substrates used for the printing plate precursor of the present invention are, for examples, wood pulp paper, synthetic pulp paper, paper made from a mixture of wood pulp and synthetic pulp, nonwoven fabric, plastic films, cloth, metal sheets, and composite sheets prepared from these substrates, which can be employed without undergoing any treatment. In order to obtain the particular smoothness specified by the present invention, and in addition, to adjust water resistance and other characteristics, these substrates can be impregnated with coating paints comprising hydrophobic resins, water-dispersible or water-soluble resins, pigments, and the like, which are employed for the underlayer or the backcoat layer as described later.

In the present invention, the supports in which the underlayers and the backcoat layers are provided on the substrates described above are preferably employed in order to satisfy printing characteristics such as recording characteristics, water resistance, and durability, and simultaneously, to adjust the support surfaces to the desired smoothness. The underlayers and the backcoat layers are formed by applying coating paints containing resins, pigments, and the like to the substrates and then drying, or by laminating. The resins used herein can be appropriately selected from among a variety of resins. Examples of the resins include hydrophobic resins such as acrylic resins, vinyl chloride resins, styrene resins, styrene-butadiene resins, styrene-acrylic resins, urethane resins, vinylidene chloride resins, and vinyl acetate resins; and hydrophilic resins such as polyvinyl alcohol resins, cellulose derivatives, starch and derivatives thereof, polyacrylamide resins, and styrene/maleic anhydride copolymers.

Examples of the pigments include clay, kaolin, talc, diatomaceous earth, calcium carbonate, aluminum hydroxide, magnesium hydroxide, titanium oxide, and mica. To achieve the desired smoothness, the particle sizes of these pigments are preferably selected. For example, as the underlayers are required to have relatively high smoothness, pigments having smaller particle sizes or excluding large size particles are preferably employed, and concretely, the particle sizes of the pigments are 8 $\mu$m or less, and preferably from about 0.5 to about 5 $\mu$m. On the other hand, as the backcoat layers are required to have somewhat lower degree of smoothness than the underlayer, pigments having relatively larger particle sizes, concretely, a particle size of 0.5 to 10 $\mu$m are preferably employed. The ratio of these pigments to the resins is preferably from 80 to 150 parts by weight for the underlayers, and from 80 to 200 parts by weight for the backcoat layers per 100 parts by weight of the resins. To obtain excellent resistance to water, it is effective that the underlayers and the backcoat layers contain water-resisting agents such as melamine resins and polyamideepichlorohydrin resins. The above-mentioned particle sizes can be measured with scanning electron micrographs. When the particles are nonspherical, diameters of such the particles are diameter obtained by converting the projected areas of the particles to those of circles.

To prepare the planographic printing plate precursor of the present invention, a solution containing components for the underlayer is applied, if necessary, to one side of a support and then dried to form the underlayer, and further a solution containing components for the backcoat layer is applied, if necessary, to another side of the support and then dried to form the backcoat layer. Thereafter, a solution containing components for the image receiving layer is applied to the underlayer and then dried to form the image receiving layer. The coating amounts for forming the image receiving layer, the underlayer, and the backcoat layer are from 1 to 30 grams/m$^2$, and particularly suitably from 6 to 20 grams/m$^2$, respectively.

Further, the thickness of the water-resistant support in which the underlayer or the backcoat layer is formed ranges from 90 to 130 $\mu$m, and preferably from 100 to 120 $\mu$m.

Solid inks used for a hot melt type ink-jet system (or solid-jet system), which are ink compositions that are solid at ordinary temperature, are described below.

As described before, the solid inks used for the present invention are solid at a temperature of 35° C. or lower and turn to hot melted liquids by heating to a temperature of 80° to 150° C. In addition, the viscosity at the hot melt ranges from 1 to 20 cps, and preferably from 2 to 15 cps. Known solid inks can be used in the present invention.

The heat-meltable inks of the present invention contain at least a wax which is solid at ordinary temperature and has a melting point of 50° to 150° C., a resin, a color material, and an adhesion modifier as ink components, and preferably have contents of 30% to 90% by weight of the wax having a melting point of 50° to 150° C., 5% to 70% by weight of the resin, 0.1% to 10% by weight of a dye or a pigment as the color material, and 2% to 40% by weight of the adhesion modifier.

The wax which can be used as a component of vehicles and has a melting point of 50° to 150° C. must be stable to heat in a hot melt state heated to not less than its melting point, or at least at ink-jetting temperatures of ink-jet printers.

Examples of such the waxes include petroleum waxes (preferably, paraffin wax and microcrystalline wax), vegetable waxes (preferably, candelilla wax, carnauba wax, rice wax, and hohoba solid wax), animal waxes (preferably, bees wax, hydrous lanolin, and spermaceti), mineral waxes (preferably, montan wax), synthetic hydrocarbons (preferably, Fischer-Tropsch wax and polyethylene wax), hydrogenated waxes (preferably, hardened castor oil and hardened castor oil derivatives), modified waxes (preferably, montan wax derivatives, paraffin wax derivatives, microcrystalline wax derivatives, and polyethylene wax derivatives), higher fatty acids (preferably, behenic acid, stearic acid, palmitic acid, myristic acid, and lauric acid), higher alcohols (preferably, stearyl alcohol and behenyl alcohol), hydroxystearic acids (preferably, 12-hydroxystearic acid and 12-hydroxystearic acid derivatives), ketones (preferably, stearone and laurone), fatty acid amides (preferably, lauric acid amide, stearic acid amide, oleic acid amide, erucic acid amide, ricinoleic acid amide, 12-hydroxystearic acid amide, special fatty acid amides, and N-substituted fatty acid amides), amines (preferably, dodecylamine, tetradecylamine, and octadecylamine), esters (preferably, methyl stearate, octadecyl stearate, glycerin fatty acid esters, sorbitan fatty acid esters, propylene glycol fatty acid esters, ethylene glycol fatty acid esters, and polyoxyethylene fatty acid esters), and polymerized waxes (preferably, an α-olefin-maleic anhydride copolymers wax). These known waxes can be employed without any particular limitation, and employed singly or as a mixture of two or more kinds thereof. The content of the waxes in the entire ink composition preferably ranges from 30% to 90% by weight.

The resins which are employed as a component of vehicles together with the waxes function to give adhesion of the inks to printing paper, to control the viscosity of the inks, to prevent the waxes from being crystallized, and in addition, to make the inks transparent.

The resins are preferably oil-soluble resins. Examples of the oil-soluble resins include olefin resins (preferably, polyethylene resins, polypropylene resins, and polyisobutylene resins), vinyl resins (preferably, ethylene-vinyl acetate copolymer resins, vinyl chloride-vinyl acetate copolymer resins, vinyl acetate resins, and ethylene-vinyl chloride-vinyl acetate copolymer resins), acrylic resins (preferably, methacrylic acid ester resins, polyacrylic acid ester resins, ethylene-ethyl acrylate copolymer resins, and ethylene-methacrylic acid ester copolymer resins), phenol resins, polyurethane resins, polyamide resins, polyester resins, ketone resins, alkyd resins, rosin resins, hydrogenated rosin resins, petroleum resins, hydrogenated petroleum resins, maleic acid resins, butyral resins, terpene resins, hydrogenated terpene resins, and chroman-indene resins. These resins (polymeric materials) can be employed singly or as a mixture of two or more kinds thereof. The content of the resins in the entire inks preferably ranges from 5% to 70% by weight.

The color materials employed herein include all dyes and pigments which have been hitherto employed for oily ink compositions.

The pigments employed herein include inorganic and organic pigments which are commonly employed in the field of printing technology. Examples thereof include carbon black, cadmium red, molybdenum red, chrome yellow, cadmium yellow, titanium yellow, chromium oxide, viridian, titanium cobalt green, ultramarine blue, Prussian blue, cobalt blue, azo pigments, phthalocyanine pigments, quinacridone pigments, isoindolinone pigments, dioxazine pigments, indanthrene pigments, perylene pigments, perinone pigments, thioindigo pigments, quinophthalone pigments, and metal complex pigments. These known pigments can be employed without any particular limitation.

The dyes employed herein are preferably oil-soluble dyes, and examples thereof include azo dyes, metal complex dyes, naphthol dyes, anthraquinone dyes, indigo dyes, carbonium dyes, quinoneimine dyes, xanthene dyes, cyanine dyes, quinoline dyes, nitro dyes, nitroso dyes, benzoquinone dyes, naphthoquinone dyes, phthalocyanine dyes, and metallophthalocyanine dyes.

These pigments and dyes can be employed singly or in combination, respectively. The content of these pigments or dyes in the whole inks preferably ranges from 0.1% to 10% by weight.

The adhesion modifiers employed herein efficiently provide plasticity and stickiness to the heat-meltable inks in a solid state to remarkably improve fixing of the inks to recording sheets and fixing of recording dots to one another without largely changing the viscosities, melting points, and melting energy of the entire inks. Examples of the adhesion modifiers include polyolefins and derivatives thereof (for example, polyolefinic polyols, etc.). The content of the adhesion modifiers in the entire inks preferably ranges from 2% to 40% by weight.

In addition, various additives such as dispersants and rust preventives can also be incorporated into the inks of the present invention. The inks can be prepared by mixing the materials as described above with the aid of heat. The melting point of the inks can be variously set by changing the kinds of constituent components employed and the mixing ratios thereof when the respective components are employed as mixtures. The melting point can be measured with conventional melting point apparatus or by the use of devices for thermal analysis such as DSC and DTA.

A process for forming images on the above-mentioned planographic printing plate precursors (hereinafter occasionally referred to as a "master") is described below. One of the device systems for executing such a process is shown in FIG. 1.

The device system shown in FIG. 1 has ink-jet recording device 1 obeying the solid-jet system in which solid inks are employed.

As shown in FIG. 1, pattern information of an image (figures and writings) that should be formed on master 2 is first supplied from an information source such as computer 3 via a transfer means such as path 4 to ink-jet recording device 1 of the solid-jet system. In ink-jet recording head section 10 of recording device 1, a solid ink is melted and stored in an ink tank, and minute droplets of ink are sprayed on to the surface of intermediate transferrer 28 described later according to the above-mentioned information, so that the ink adheres to the surface of intermediate transferrer 28 in the above-mentioned pattern. The thickness of an adhering ink layer is usually from 1 to 50 $\mu$m, and preferably from 3 to 35 $\mu$m.

Figure 2:
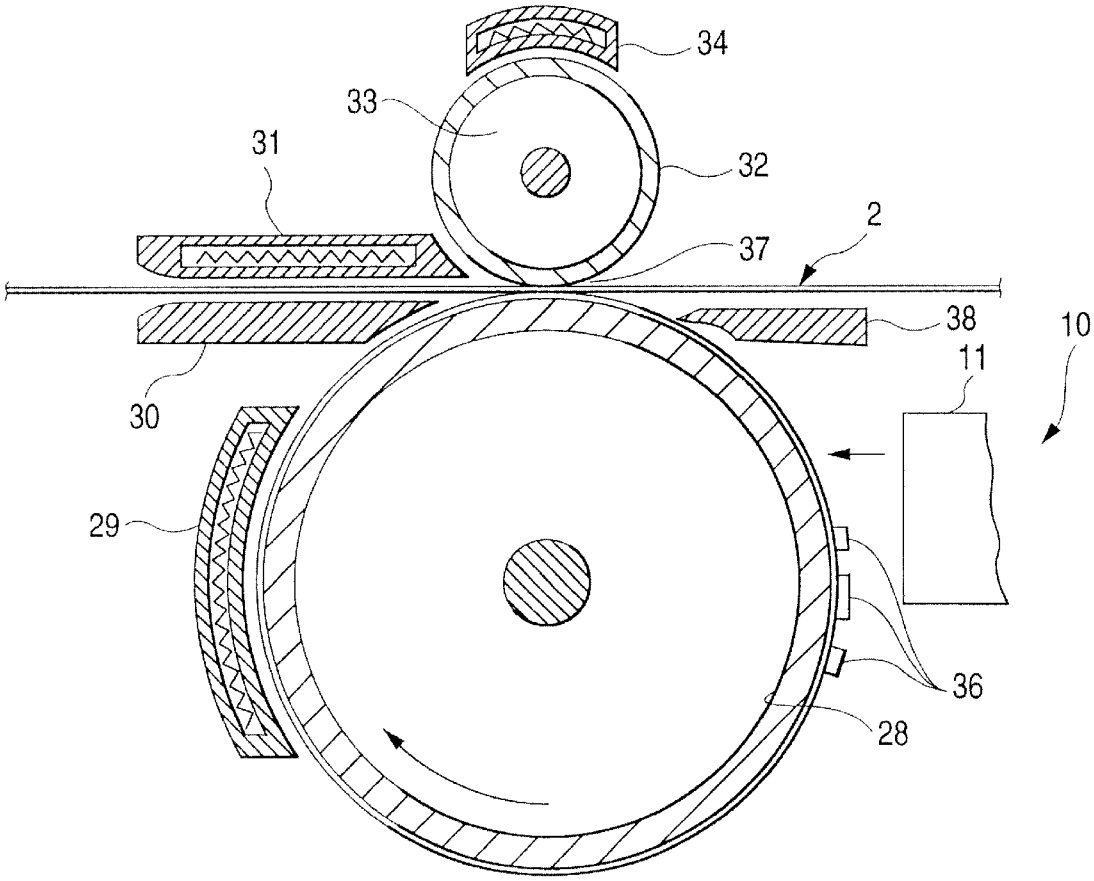
FIG. 2 is a schematic view showing an important section of an ink-jet recording device used in the present invention.
Figure 3:
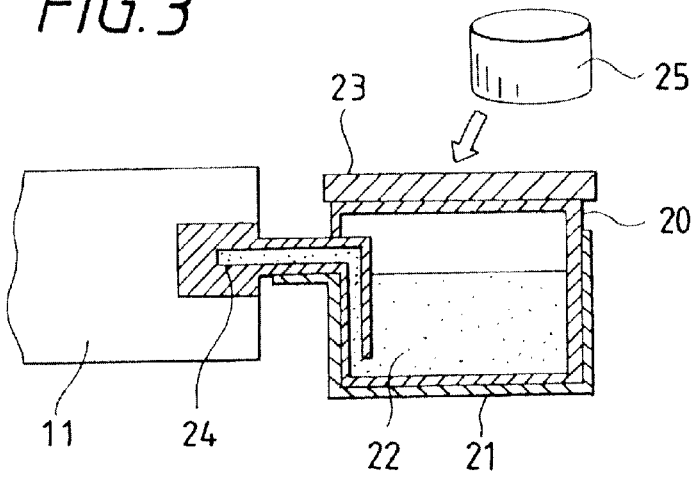
FIG. 3 is a schematic view showing a head section of the ink-jet recording device used in the present invention.
Figure 4:
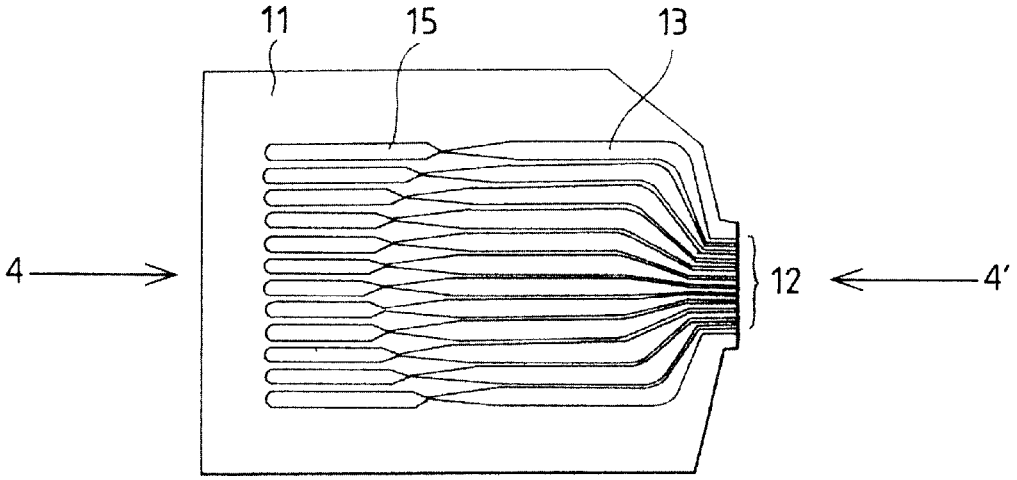
FIG. 4 is a schematic view showing an ink-jet head in the head section of the ink-jet recording device used in the present invention.

Structures of the ink-jet recording device in the device system of FIG. 1 are exemplified in FIG. 2 to FIG. 4. In FIG. 2 to FIG. 4, members common to those in FIG. 1 are indicated by the same signs.

FIG. 2 is a schematic view showing an important section of the ink-jet recording device. In the ink-jet recording device of FIG. 2, the ink image on the surface of the intermediate transferrer is transferred to the master according to a rapid process. Print head 11 is fixed to a supporting element (not shown in the figure) or in a movable condition in a suitable housing, and allows a melted ink to adhere to intermediate transferrer 28. Intermediate transferrer 28 may be a web or a platen as well as a drum, and may be made of suitable materials. Although such materials are not particularly limited, they may include metals such as aluminum, nickel, and iron phosphate; elastomers such as fluorocarbon elastomers, perfluorocarbon elastomers, silicone rubber, and polybutadiene; plastics such as polytetrafluoroethylene into which polyphenylene sulfide is incorporated; thermoplastic resins such as polyethylene, nylon, and fluorinated ethylene propylene resins; thermosetting resins such as acetal; and ceramics. All these materials can be adopted, as long as they can satisfy the following conditions. That is, the exposed surface of intermediate transferrer 28 has a sufficient hardness; master 2 can smoothly pass between intermediate transferrer 28 and transferring roller 32; and intermediate transferrer 28 has no trouble to support image forming inks. A suitable material for intermediate transferrer 28 is aluminum which is subjected to the anodization treatment. The smoothness of the surface of intermediate transferrer 28 is at least 300 seconds per 10 ml, preferably at least 800 seconds per 10 ml, and more preferably from 1000 to 3000 seconds per 10 ml in Bekk smoothness degree.

Master guide 30 in FIG. 2 helps master 2 to pass from a feeder (not shown in the figure) and guides it to intermediate transfer section 37 which is interposed by roller 32 and intermediate transferrer 28. A plurality of stripping fingers 38 (Only one finger is shown in the figure) are attached to printer device 10 to strip master 2 from the surface of intermediate transferrer 28. Roller 32 consists of core 33 made of metal (preferably steel) and an elastomer which is provided on the periphery of the core and has a Shore D hardness of about 40 to about 45. Preferred materials for the elastomers are silicone, urethane, nitrile, EPDM, and the like. Master 2 is pressed by the elastomer which covers roller 32, an ink image 36 is melted or fixed, and the ink image is expanded and stretched to be fixed.

The inks which are employed for this process, that is, for the system of the present invention, are solid in an initial state and turn to liquids when heated to about 85° to about 150° C. The inks may undergo deterioration or chemical decomposition at temperatures exceeding this range. The melted inks are sprayed onto the surface of intermediate transferrer 28 from an ink-jet hole of print heat 11 by the raster scan system. The inks are cooled here to solidify to the extent of a flexible state, and contact-transferred to master 2 interposed between intermediate transferrer 28 and roller 32 at intermediate transfer section 37. The temperature at which the inks are maintained in the flexible state is from about 30° to about 80° C.

When ink image 36 in the flexible state is interposed between roller 32 and intermediate transferrer 28, the image is deformed to a final image which is fixed on master 2 under pressure applied from roller 32, and in addition, with the aid of heat from heater 29 or heater 31. To facilitate this processing, heater 34 can be further provided. Pressure applied on ink image 36 is preferably from about 1 to about 150 kgf/cm$^2$, more preferably from about 30 to about 100 kgf/cm$^2$, and most preferably from about 50 to about 60 kgf/cm$^2$. These are high pressures enough to fix ink image 36 on master 2.

The ink image fixed on master 2 is cooled to environmental temperature of about 20° to about 25° C. The ink of the ink image intrinsically needs ductility, and must be deformed without breaking, even when maintained at a temperature exceeding a glass transition temperature. The ink becomes hard at not more than the glass transition temperature. The temperature at which the ink image transferred can maintain the flexible state involving the ductility ranges from about −10° to about 120° C., and preferably from about 10° to about 90° C. As master 2 is usually porous as described above, the ink soaks into the image receiving layer of master 2 to be accepted.

Although heater 29 may be a radiation type resistance heater arranged as shown in FIG. 2, it is best that the heater is arranged into intermediate transferrer 28. Heaters 31 and 34 may be arranged in master guide 30 and melting-fixing roller 32, respectively. Heater 29 can raise the temperature of intermediate transferrer 28 to about 25° to about 100° C. The temperature preferably ranges from about 40° to about 80°.

Master 2 is preferably preheated to about 70° to about 130° C. by heater 31 before ink image 36 is fixed. The temperature of roller 32 can be raised to about 25° to about 200° C. by heater 34.

The ink is sprayed on to the surface of intermediate transferrer 28 from ink-jet head 11 as described above.

FIG. 3 is a schematic view showing head section 10 in the ink-jet recording device described above. As shown in FIG. 3, head section 10 is mainly constituted by ink-jet head 11 and ink tank 20. Further, head section 10 has means 21 for heating and melting solid ink 25. For example, a heating resistor can be employed for such a means, and the heating resistor is employed in the explanation given herein. Ink 22 melted by heating resistor 21 is placed in ink tank 20 of head section 10, and ink tank 20 is fitted with tank cap 23. Further, head section 10 has ink supplying path 24 through which melted ink 22 in ink tank 20 is supplied to ink-jet head 11.

Solid ink 25 which is placed in ink tank 20 by an operator is heated and melted by heating resistor 21 provided so as to wrap ink tank 20, and supplied to ink-jet head 11 through ink supplying path 24.

Figure 5:
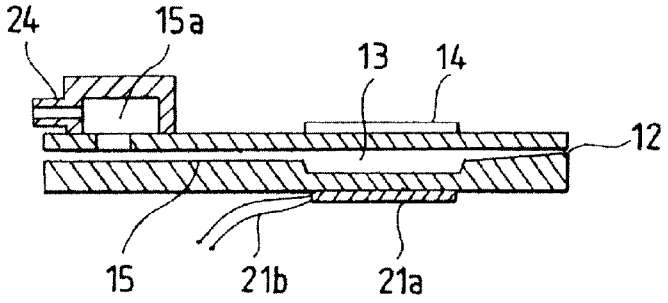
FIG. 5 is a cross-sectional view along the line 4—4' of FIG. 4.

FIG. 4 is a schematic view for illustrating ink-jet head 11 described above. As shown in FIG. 4 and FIG. 5, ink-jet head 11 is made up of nozzles 12, pressurizing chambers 13, piezo-electric elements 14 for pressurizing an ink in pressurizing chambers 13, common ink chambers 15, ink supplying exit 15*a*, heating resistors 21*a* for heating melted ink 22 to maintain at a constant temperature, and electrodes 21*b*. Melted ink 22 is supplied from common ink chambers 15 to pressurizing chambers 13, and sprayed from nozzles 12 by driving piezo-electric elements 14, while maintaining melted ink 22 at optimum spraying temperature by heating resistors 21*a*. After adhering to intermediate transferrer 28, sprayed melted ink 22 is transferred to master 2, permeates the master, and solidifies to achieve fixing.

Although the above-mentioned ink-jet head 11 has been illustrated by the use of an electromechanical transducer such as the piezo-electric element, an effect equivalent to that of the transducer can be attained by other pressurizing means such as a wire type pressurizing system. Further, a heating means such as a ceramic heater can also be employed in addition to the heating resister. The temperature of melted ink 22 in ink tank 20 is not required to be as high as that of the ink which is present in pressurizing chambers 13 immediately before being sprayed. Therefore, heating resistor 21 provided outside ink tank 20 and heating resistors 21*a* provided outside pressurizing chambers 13 may be separately operated to depress an increase in temperature within the ink-jet recording device.

On the other hand, when ink tank 20 and ink-jet head 11 are heated to a similar temperature, it is possible to heat them separately them by heating resistors 21 and 21*a* as described above. However, both ink tank 20 and ink-jet head 11 can also be covered as one body with a heating system into which nichrome wires are incorporated.

The temperature of the head of the ink-jet recording device is set in the range of 80° to 150° C., and preferably in the range of 90° to 130° C.

Techniques for employing solid inks can be widely utilized for the recording head used herein, and in addition, it is desirable to employ a recording head which yields high resolving power.

For example, a sharp image with a resolving power of 600 dpi can be formed by feeding a solid ink to ink tank 20 of the ink-jet recording device of FIG. 3 and spraying a melted ink having a particle size of 60 $\mu$m from the nozzles having a diameter of 40 $\mu$m under the conditions of a head temperature of 120° C., a piezo-electric element drive voltage of 70 volts, and a sprayed ink viscosity of 20 cps.

As intermediate transferrer 28 revolves, ink image 36 on the surface of intermediate transferrer 28 is cooled to an intermediate state of a ductile solid and enters intermediate transfer section 37 which is interposed by roller 32 and intermediate transferrer 28. Ink image 36 is deformed to a final image by applying pressure and transferred to the surface of master 2. Thus, ink image 36 is transferred to master 2 by the pressure applied by the elastic surface of roller 32.

Master 2 which is thus prepared by forming an image on a planographic printing plate precursor according to the solid-jet system is subjected to a surface treatment by the use of a desensitizing solution to desensitize a nonimage area, thus a printing plate being made.

Known desensitizing solutions for zinc oxide include processing solutions which contain as main components cyan compounds such as ferrocyanates or ferricyanates; cyan-free processing solutions which contain as main components ammine cobalt complexes, phytic acid or derivatives thereof, or guanidine derivatives; processing solutions which contain as main components inorganic or organic acids that react with zinc ion to form chelates; and processing solutions which contain water-soluble polymers.

The processing solutions which contain the cyan compounds include, for example, those which are described in JP-B-44-9045, JP-B-46-39403, JP-A-52-76101, JP-A-57-1107889, JP-A-54-117201, etc.

The processing solutions which contain the phytic acid type compounds include those listed in JP-A-53-83807, JP-53-83805, JP-A-53-102102, JP-A-53-109701, JP-A-53-127003, JP-A-54-2803, JP-A-54-44901 etc.

The processing solutions which contain metal complex compounds such as cobalt complexes include those listed in JP-A-53-104301, JP-A-53-140103, JP-A-54-18304, and JP-B-43-28404.

The processing solutions which contain the inorganic or organic acids include those listed in JP-B-39-13702, JP-B-40-10308, JP-B-43-28408, JP-B-40-26124, JP-A-51-118501, etc.

The processing solutions which contain the guanidine compounds include those described in JP-A-56-111695, etc.

The processing solutions which contain the water-soluble polymers include those described in JP-A-52-126302, JP-A-52-134501, JP-A-53-49506, JP-A-53-59502, JP-A-53-104302, JP-B-38-9665, JP-B-39-22263, JP-B-40-763, JP-B-40-2202, JP-A-49-36402, etc.

In the desensitizing for which all these processing solutions are employed, it is considered that the zinc ion is liberated from the zinc oxide in the layer surface, and the ion undergoes the chelation reaction with those chelating agents in the processing solutions to produce zinc chelate compounds, which are precipitated on the layer surface to become water-receptive.

The desensitizing is usually carried out at ordinary temperature (about 15° to about 35° C.) for about 2 to about 60 seconds. This printing plate can endure offset printing of about 3000 sheets by the use of fountain solution.

The present invention is illustrated below by examples in detail. However, the contents of the present invention are not limited by these examples.

EXAMPLE 1

A mixture of 100 grams of dry zinc oxide, 3.0 grams of binder resin (B-1), 17.0 grams of binder resin (B-2) (Binder resins (B-1) and (B-2) have structures shown below, respectively), 0.15 gram of benzoic acid, and 155 grams of toluene was dispersed for 8 minutes at $1\times10^4$ rpm with a wet dispersing homogenizer (manufactured by Nippon Seiki Co., Ltd.).

Binder Resin (B-1) Mw: $8 \times 10^3$

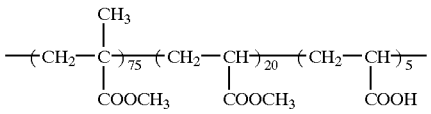

Binder Resin (B-2) Mw: $6 \times 10^4$

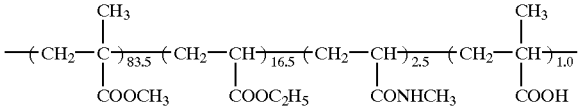

(Numerical values indicate a weight ratio of starting monomers; Mw: Weight-average molecular weight)

The composition given above was applied with a wire bar to a support (having an underlayer with a smoothness degree of 50° seconds per 10 ml) of ELP-1 type master (trade name, manufactured by Fuji Photo Film Co., Ltd.) which is employed as an electrophotographic planographic printing plate precursor for small printing, and dried at 100° C. for 1 minute to form an image receiving layer, coating amount of which was 8 grams/$m^2$. A printing plate precursor thus prepared is designated as sample No. 1.

The smoothness degree of the image receiving layer's surface of the printing plate precursor was 205 seconds per 10 ml.

A planographic printing plate precursor was prepared, similarly to sample No. 1, except that a support (having an underlayer with a smoothness degree of 1800 seconds per 10 ml) of ELP-1X type master (trade name, manufactured by Fuji Photo Film Co., Ltd.) was employed in place of the support of ELP-1 type master which was employed as a water-resistant support in sample No. 1. The printing plate precursor thus obtained is designated as sample No. 2.

Further, a commercially available direct drawing type printing plate precursor in which the image receiving layer has a water-receptive surface was employed as sample No. 3. The results are shown in Table 1.

Measurements of the water-contact angles and the smoothness degrees of samples No. 1 to No. 3 were measured according to the following manners, respectively.

1) Two $\mu$l of distilled water was placed on the respective surfaces of the printing plate precursors, and after 30 seconds, the surface contact angles (degree) were measured with a surface contact angle gauge (CA-D, manufactured by Kyowa Kaimenkagaku Co., Ltd.). Lower numerical values thereof indicate that surfaces have better water wettability and are more water-receptive.

2) Smoothness Degree of Image Receiving Layer

The smoothness degrees (second per 10 ml) of the printing plate precursors were measured by the use of a Bekk smoothness testing machine (manufactured by Kumagaya Riko Co., Ltd.) at an air volume of 10 ml.

The smoothness degrees of the supports as indicated above also were measured in the same manner as described here. Subsequently, planographic printing plate precursors were made by the use of Phaser 340 JS Printer (manufactured by Sony-Tektronix Co., Ltd.) which is commercially available as a solid-jet printer that performs image formation on a recording medium via an intermediate transferrer and a black solid ink (Instick Black: a specialized ink for the printer).

The structure of the printer employed above is in accordance with the structures shown in FIG. 2 to FIG. 4. The black solid ink contains a wax having a melting point of about 100° C., and the ink melted at about 120° C. and has a viscosity of about 20 cps. The intermediate transferrer's drum is aluminum which is subjected to anodization treatment and has a Bekk smoothness degree of at least 3000 seconds per 10 ml. The temperature of the intermediate transfer section was adjusted to 50° C.

Qualities of duplicated images on the printing plate precursors thus formed were evaluated in the following manner. The results are shown in Table 1.

3) Image Qualities of Printing Plates

The duplicated images of the printing plates obtained were examined at ×200 magnification with an optical microscope to evaluate image qualities. The results of evaluation are shown by signs ⊚, ○, Δ, x, and xx.

⊚ A duplicated image has no problem at all. Fine lines and small characters also are very good.

○ A duplicated image has no problem. Fine lines and small characters also are good.

Δ A very little falling is observed in fine lines and small characters of Mincho type, and a few blurs also are observed therein. Slightly inferior.

x A little falling is observed in fine lines and small characters, and blurs also are somewhat observed therein. Bad.

xx Falling is observed in fine lines and small characters of Mincho type, and blurs also are observed therein. Very bad.

After platemaking was performed according to the procedure described above, a desensitizing solution (ELP-E2: trade name, manufactured by Fuji Photo Film Co., Ltd.) was placed in the etcher section of a fully-automatic printing machine (AM-2850, trade name, manufactured by A. M. Co., Ltd.), and a solution prepared by diluting a desensitizing solution (SICS) four times with distilled water was placed in the fountain solution saucer of the printing machine. The printing plates were then set on the printing machine, and printing was performed by the use of a black ink for offset printing.

However, sample No. 3 is a printing plate precursor in which the image receiving layer has a water-receptive surface, and consequently, printing was carried out without desensitizing treatment.

Images on printed matter and press lives of the printing plates were evaluated according to the following procedures, respectively. The results are shown in Table 1.

4) Printed Images

Images on the respective tenth printed sheets obtained from the printing plates were visually examined with a magnifying glass of ×20 magnification (as to scumming, uniformity in screen tint areas, and uniformity of solid in image areas). The results of evaluation are shown by signs ⊚, ○, Δ, x, and xx.

⊚ A duplicated image has no problem at all. Fine lines and small characters are very good.

○ A duplicated image has no problem. Fine lines and small characters also are good.

Δ A very little falling is observed in fine lines and small characters of Mincho type, and a few blurs are observed therein. slightly inferior.

x A little falling is observed in fine lines and small characters of Mincho type, and blurs are somewhat observed therein. Bad.

xx Falling is observed in fine lines and small characters, and blurs are observed therein. Very bad.

5) Press Lives

The numbers of sheets which can be printed without scumming or falling of image observed by the visual eyes were examined.

TABLE 1

| Sample No. | Characteristics of Printing Plate Precursor: Image Receiving Layer: Water-Contact Angle (deg) | Smoothness Degree (sec/10 ml) | Support Smoothness Degree (sec/10 ml) | Image: Quality of Printing Plate Precursor | Printed Image | Press Lives (sheets) |
|---|---|---|---|---|---|---|
| 1 (Present Invention) | 98 | 205 | 500 | ○*1 | ○*1 | 3000 |
| 2 (Present Invention) | 98 | 200 | 1800 | ◎*2 | ◎*2 | 3000 |
| 3 (Comparative Example) | 5 | 200 | 1800 | xx*3 | xx*3 | 50 |

*1Reproducibility in fine lines and small characters is satisfactory.
*2Very good. Fine lines and small characters are sharply reproduced.
*3Blurs in fine lines and small characters are remarkable.

The results shown in Table 1 are considered as follows.

The smoothness of the image receiving layers of samples No. 1 to No. 3 was nearly equivalent in Bekk smoothness degree. About wetting properties of the respective printing plate precursors, samples No. 1 and No. 2 had high water-contact angles, which showed that these samples had very hydrophobic surfaces. On the other hand, sample No. 3 had a low water-contact angle, which showed that this sample had a very water-receptive surface.

In the image qualities of the printing plates, sample No. 2 was very satisfactory and sharp, and sample No. 1 exhibited satisfactory reproducibility in fine lines and small characters. That is, this shows that higher smoothness of an underlayer's surface adjacent to an image receiving layer forms better image on a printing plate. On the other hand, in sample No. 3, the image was remarkably blurred in fine lines and small characters.

In samples No. 1 and No. 2, image qualities of the printed matter obtained by offset printing were reproduced to an extent equivalent to image qualities of the respective printing plate, and the numbers of printed matter having such the image qualities were 3000 sheets, respectively. On the other hand, in sample No. 3, images of the printed matter were blurred, and falling of the image areas was developed in printing of about 50 sheets.

EXAMPLE 2

Preparation of Water-Resistant Support

An aqueous latex of an ethylene-methyl acrylate-acrylic acid copolymer (molar ratio: 65:30:5) was applied to both sides of wood free paper with a weighing of 95 grams/$m^2$ so as to become 0.2 gram/$m^2$ in dry coating amount, and then dried. Subsequently, an uniform polyethylene film of 25 $\mu$m in thickness (surface specific resistivity: $6\times10^9$ Ω) was laminated to one side of the substrate thus obtained by an extruding process by the use of pellets prepared by melting and kneading a mixture of 70% of low-density polyethylene with a density of 0.920 gram/ml and a melt index of 5.0 grams per 10 minutes, 1.5% of high-density polyethylene with a density of 0.950 gram/ml and a melt index of 8.0 grams per 10 minutes, and 15% of electrically conductive carbon. The smoothness degree was then adjusted to 2000 seconds per 10 ml by the calender treatment.

Further, a coating for a backcoat layer having the following composition was applied to another side of the substrate with a wire bar to provide a backcoat layer in a dry coating amount of 20 grams/$m^2$ (surface specific resistivity: $8\times10^7$ Ω), and the backcoat layer then was subjected to the calender treatment, conditions of which were set so that the layer surface had a smoothness degree of 450 seconds per 10 ml.

Coating for Backcoat Layer

| | |
|---|---|
| Clay (50% Aqueous Dispersion) | 200 parts by weight |
| Oxidized Starch (20% Aqueous Solution) | 40 parts by weight |
| SBR Latex (Solid Content 49%, Tg 10° C.) | 150 parts by weight |
| Initial Condensation Product of Melamine Resin (Solid Content 80%, Sumirez Resin SR-613) | 10 parts by weight |

Thereafter, the surface of the polyethylene layer was subjected to the corona discharge treatment at 5 KVA·sec/$m^2$, and a coating paint for an image receiving layer having the following composition was applied to the support thus treated, and then dried to form the image receiving layer.

Preparation of Planographic Printing Plate Precursor

A mixture of 100 grams of dry zinc oxide (manufactured by Seido Chemical Co., Ltd.) which was the same as in Example 1, 16 grams of binder resin (B-3), 4 grams of binder resin (B-4) (Binder resins (B-3) and (B-4) have structures shown below, respectively), 0.36 gram of 3-propoxybenzoic acid, and 155 grams of toluene was dispersed at $1\times10^4$ rpm with a wet dispersing machine, KADY mill, for 20 minutes.

Binder Resin (B-3) Mw: $7\times10^4$

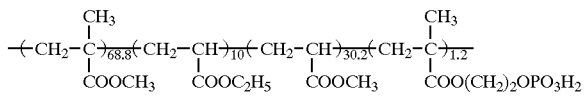

Binder Resin (B-4) Mw: $6\times10^3$

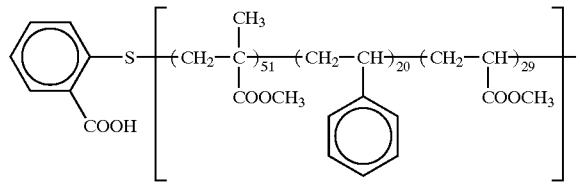

(numerical values indicate a weight ratio of starting monomers; Mw: Weight-average molecular weight)

The resulting dispersion was applied to the water-resistant support prepared above with a wire bar so as to become 10 grams/m$^2$ in coating amount, and then dried to prepare a planographic printing plate precursor having a surface smoothness degree of 180 seconds per 10 ml.

Similarly to Example 1, the printing plate precursor thus prepared was subjected to the platemaking and desensitizing treatment to make a printing plate which was employed for offset printing.

Similarly to sample No. 2 of Example 1, the printing plate had sharp image quality.

Printed matter of at least 3000 sheets obtained from the printing plate developed no scumming in nonimage areas and had sharp image quality, similarly to sample No. 2 of Example 1, which shows that the printing plate is excellent in both printed image and press life.

EXAMPLE 3

Preparation of Water-Resistant Support

Wood free paper with a weighing of 100 grams/m$^2$ was employed as a substrate, and a coating paint for an underlayer having the following composition was applied to one side of the substrate with a wire bar to provide an underlayer of 10 grams/m$^2$ in dry coating amount. The surface of the underlayer had a smoothness degree of 150 seconds per 10 ml, and was adjusted to 1500 seconds per 10 ml by the calender treatment.

Coating for Underlayer

| | |
|---|---|
| Silica Gel | 10 parts by weight |
| SBR Latex (50 wt % Aqueous Dispersion, Tg 25° C.) | 92 parts by weight |
| Clay (45 wt % Aqueous Dispersion | 110 parts by weight |
| Melamine (80 wt % Aqueous Solution) | 5 parts by weight |
| Water | 191 parts by weight |

Further, a coating paint for a backcoat layer having the following composition was applied to another side of the substrate with a wire bar to provide a backcoat layer of 12 grams/m$^2$ in dry coating amount, and the backcoat layer then underwent the calender treatment, conditions of which were set so that the layer surface had a smoothness degree of about 50 second per 10 ml.

Coating for Background Layer

| | |
|---|---|
| Kaolin (50% Aqueous Dispersion) | 200 parts by weight |
| Aqueous Solution of Polyvinyl Alcohol (10%) | 60 parts by weight |
| SBR Latex (Solid Content 49%, Tg 0° C.) | 100 parts by weight |
| Initial Condensation Product of Melamine Resin (Solid Content 80%, Sumirez Resin SR-613) | 5 parts by weight |

Preparation of Fresh Planographic Printing Plate Precursor

A mixture of 100 grams of dry zinc oxide (manufactured by Seido Chemical Co., Ltd.) which was the same as in Example 1, 16 grams of binder resin (B-5), 4 grams of binder resin (B-6) (Binder resins (B-5) and (B-6) have structures shown below, respectively), 0.36 grams of 3-propoxybenzoic acid, and 155 grams of toluene was dispersed at 1×10$^4$ rpm with a wet dispersing machine, KADY mill, for 20 minutes.

Binder Resin (B-5) Mw: 5 x 10$^4$

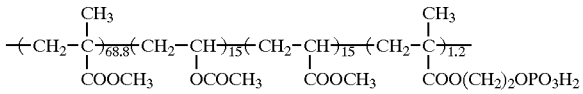

Binder Resin (B-6) Mw: 8 x 10$^3$

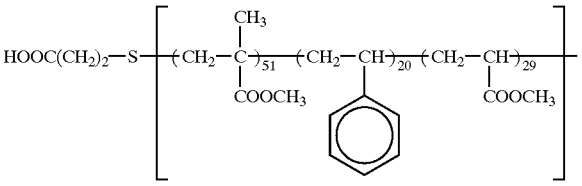

(Numeral values show a weight ratio of the starting monomers; Mw: Weight-average molecular weight)

The resulting dispersion was applied to the water-resistant support prepared above with a wire bar so as to be 12 grams/m$^2$ in coating amount, and then dried to prepare a fresh planographic printing plate precursor having a surface smoothness degree of 150 seconds per 10 ml.

Similarly to Example 1, the printing plate precursor thus prepared was subjected to the platemaking and desensitizing treatment to make a printing plate which was employed for offset printing.

Similarly to sample No. 2 of Example 1, the printing plate thus made had a sharp and satisfactory image quality.

Printed matter of at least 3000 sheets obtained from the printing plate developed no scumming in nonimage areas and had sharp image quality, similarly to sample No. 2 of Example 1, which shows that the printing plate is excellent in both printed image and press life.

EXAMPLE 4

Preparation of Fresh Planographic Printing Plate Precursor

A mixture of 100 grams of dry zinc oxide (manufactured by Seido Chemical Co., Ltd.) which was the same as described above in Example 1, 14 grams of binder resin (B-7) having a structure shown below, 1.5 grams (as solid content) of a dispersion of acrylic acid resin particles described below, 0.20 gram of m-toluic acid, and 230 grams of toluene was placed together with 200 grams of glass beads having diameters of 0.7 to 1 mm in a DYNO mill dispersing machine (manufactured by Shinmaru Enterprise Co., Ltd.), and dispersed at 5×10$^3$ rpm for 10 minutes. The glass beads were separated by filtration, and the filtrate was employed as a coating paint for an image receiving layer.

Binder Resin (B-7) Mw: 5 x $10^4$

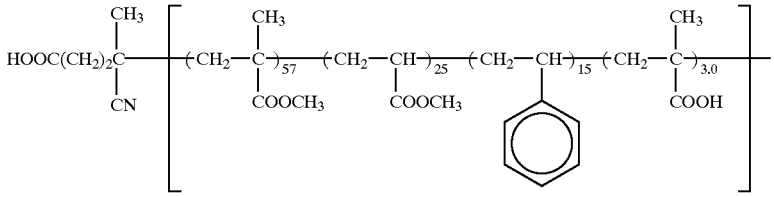

(Numeral values show a weight ratio of the starting monomers; Mw: Weight-average molecular weight)

Dispersion of Acrylic Acid Resin Particles

A solution of 8 grams of acrylic acid, 2 grams of AA-6 (trade name of methyl methacrylate macromonomer, manufactured by Toagosei Co., Ltd.), 2 grams of ethylene glycol dimethacrylate, and 0.1 gram of methyl 3-mercaptopropionate in 55 grams of methyl ethyl ketone was heated to 60° C. in a stream of nitrogen. Subsequently, 0.2 gram of 2,2'-azobis(isovaleronitrile) was added to the heated solution, and the resulting mixture was allowed to react for 3 hours. Thereafter, 0.1 gram of the initiator was further added to the reaction mixture to continue the reaction for 4 hours. The dispersion thus obtained had a conversion degree of 95%. The average size of dispersed resin particles therein was 0.20 $\mu$m, and the dispersion had good monodispersity (Measurement of particle sizes was made with CAPA-500 (trade name) manufactured by Horiba Seisakusho).

The coating paint for an image receiving layer prepared above was applied to a water-resistant support similar to that used for sample No. 2 of Example 1 with a wire bar so as to be 16 grams/$m^2$ in coating amount, and then dried to prepare a planographic printing plate precursor.

The smoothness of the image receiving layer's surface thus provided was 160 seconds per 10 ml in Bekk smoothness degree.

Similarly to Example 1, the printing plate precursor was subjected to the platemaking and desensitizing treatment to make a printing plate which was employed for offset printing.

Similarly to sample No. 2 of Example 1, the printing plate had a sharp and satisfactory image quality.

Printed matter of at least 3000 sheets obtained from the printing plate developed no scumming in nonimage areas and had sharp image qualities, similarly to sample No. 2 of Example 1.

Thus, the above results indicate that the present invention can provide printed matter having sharp images and printing plates having excellent press lives.

While the invention has been described in detail and with reference to specific embodiments thereof, it will be apparent to one skilled in the art that various changes and modifications can be made therein without departing from the spirit and scope thereof.

What is claimed is:

1. A process for preparing an ink-jet system printing plate, wherein an image is formed according to a hot melt type ink-jet system by heat-melting an ink composition that is solid at temperatures of 35° C. or lower, spraying droplets of the ink composition in a hot melt state from nozzles onto an intermediate transferrer to form an image, and contact-transferring the image on the intermediate transferrer to an image receiving layer of a planographic printing plate precursor, the image receiving layer being provided on a water-resistive support and containing zinc oxide and a binder resin and having a surface with a water-contact angle of 50° or more, and thereafter, a nonimage area of the image receiving layer is desensitized by chemical reaction treatment to prepare a planographic printing plate.

2. A process for preparing an ink-jet system printing plate as claimed in claim 1, wherein the surface of the image receiving layer of the planographic printing plate precursor has a Bekk smoothness degree of at least 30 seconds per 10 ml.

3. A process for preparing an ink-jet system printing plate as claimed in claim 1, wherein said ink composition contains a wax having a melting point of from 50° to 150° C., a resin, a color material, and an adhesion modifier and turns to a hot melted liquid by heating to 80° C. or higher, the hot melted liquid having a viscosity of from 1 to 20 cps.

4. A process for preparing an ink-jet system printing plate as claimed in claim 1, wherein the water resistant support has a support surface adjacent to the image receiving layer, said support surface having a Bekk smoothness depress of at least 300 seconds per 10 ml.

5. The process of claim 1 wherein the contact angle is not more than 130°.

6. The process of claim 1 wherein the contact angle is not more than 120°.

7. The process of claim 1 wherein the contact angle is not more than 110°.

* * * * *